US008477084B2

(12) United States Patent
Chung et al.

(10) Patent No.: US 8,477,084 B2
(45) Date of Patent: Jul. 2, 2013

(54) ORGANIC ELECTROLUMINESCENCE DISPLAY AND METHOD OF DRIVING THE SAME

(75) Inventors: Hoon Ju Chung, Gyeonggi-Do (KR); Chang Hoon Jeon, Gyeongsangbuk-Do (KR)

(73) Assignee: LG Display Co., Ltd., Seoul (KR)

( * ) Notice: Subject to any disclaimer, the term of this patent is extended or adjusted under 35 U.S.C. 154(b) by 629 days.

(21) Appl. No.: 11/140,584

(22) Filed: May 27, 2005

(65) Prior Publication Data

US 2005/0275608 A1 Dec. 15, 2005

(30) Foreign Application Priority Data

May 31, 2004 (KR) ..... 2004-039353

(51) Int. Cl.
*G09G 3/30* (2006.01)

(52) U.S. Cl.
USPC ..... 345/76; 345/30; 345/55

(58) Field of Classification Search
USPC ..... 345/76–83
See application file for complete search history.

(56) References Cited

U.S. PATENT DOCUMENTS

| | | | | |
|---|---|---|---|---|
| 6,859,232 | B1 * | 2/2005 | Tonami et al. | 348/302 |
| 7,015,882 | B2 * | 3/2006 | Yumoto | 345/76 |
| 2001/0003446 | A1 * | 6/2001 | Takafuji | 345/98 |
| 2003/0189541 | A1 * | 10/2003 | Hashimoto | 345/89 |
| 2004/0233148 | A1 * | 11/2004 | Tanghe et al. | 345/83 |

* cited by examiner

*Primary Examiner* — Alexander Eisen
*Assistant Examiner* — Christopher E Leiby
(74) *Attorney, Agent, or Firm* — Brinks Hofer Gilson & Lione

(57) ABSTRACT

An organic electroluminescence display has data, gate, and signal lines arranged on a substrate. Pixel regions are defined by the gate and signal lines. Switching elements provided in the pixel regions are electrically connected to the signal lines and the gate lines. Switching blocks open and close an electrical connection between the signal lines and the pixels. A driving unit drives the switching elements by supplying scanning signals to the gate lines. The driving unit also supplies a first control signal before the scanning signals are supplied and a second control signal when the scanning signals are supplied. The second control signal makes the switching blocks sequentially conductive, during which time image signals are supplied to the data lines. The first control signal permits the signal lines to be set at a predetermined voltage.

30 Claims, 6 Drawing Sheets

ORGANIC ELECTROLUMINESCENCE DISPLAY AND METHOD OF DRIVING THE SAME

CLAIM FOR PRIORITY

This application claims the benefit of priority to Korean Patent Application No. 2004-039353, filed on May 31, 2004 which is hereby incorporated by reference as if fully set forth herein.

FIELD OF THE INVENTION

The present invention relates to an organic electroluminescence display that prevents a lighting emitting element from malfunctioning by retaining image signals upon applying each scanning signal by applying a set voltage to pixels and driving the same before applying scanning signals, and a method of driving the same.

DESCRIPTION OF THE BACKGROUND ART

Generally, a cathode ray tube (CRT) has been one of widely used display devices. The CRT is mainly used for television monitors, in measuring instruments, information terminal equipment, etc. However, with the demand for miniaturization and lightweight design of electronic products, the CRT is problematic due to the weight and size of the products.

Therefore, to replace the above cathode ray tube, various flat panel display (FPD) devices such as liquid crystal display (LCD) devices, plasma display panels (PDPs), field emission display (FED) devices and electroluminescence display (ELD) devices have been researched and developed. The FPD devices thin, lightweight and have low power consumption, compared with CRTs.

Among these display devices, the organic electroluminescence display is a display device that electrically excites fluorescent organic compounds to emit light, which can display an image by voltage-driving or current-driving an array of M×N organic light emitting pixels.

The organic electroluminescence display can display colors close to natural colors since it can express visible light such as blue. The organic electroluminescence display has a high brightness and low power consumption. Moreover, the organic electroluminescence display does not have a limited viewing angle and is stable under low temperature conditions, unlike a liquid crystal display device provided with a liquid crystal layer. In addition, because the organic electroluminescence display is self luminescent, it is suitable for an ultra-thin type display device, and its production cost can be lowered because it has a simple manufacturing process. The organic electroluminescence display is also suitable for displaying moving images device as the response time is a few microseconds (μs).

As an organic electroluminescence display, an active matrix type in which a plurality of pixels is arranged in a matrix form and image information is selectively supplied to each pixel through a switching element, such as a thin film transistor, has been widely applied.

FIG. 1 is an exemplary view showing a general active matrix organic electroluminescence display.

Referring to FIG. 1, the organic electroluminescence display includes a plurality of gate lines GL1 to GLm and data lines DL1 to DLn arranged on a substrate 1 in longitudinal and transverse directions, a plurality of pixels P1 provided on areas defined by the gate lines GL1 to GLm and the data lines DL1 to DLn crossing each other, a data driving unit 30 for supplying an image signal to the pixels P1 via the data lines DL1 to DLn, and a gate driving unit 20 for applying scanning signals to the pixels P1 via the gate lines GL1 to GLm.

The gate driving unit 20 applies scanning signals to the gate lines GL1 to GLm in sequence. Switching elements electrically connected to the gate lines GL1 to GLm to which the scanning signals are applied are conductive, and the data driving unit 30 applies image signals to the data lines DL1 to DLn, thereby applying the image signals to the pixels P1 via the conductive switching elements. Each pixel P1 generates light by an organic electroluminescence device (not shown) according to the voltage level of input image signals.

With recent improvement of the resolution of organic electroluminescence displays, it is possible to realize sharper images. However, this is restricted by a limited space of the substrate 1 because a great deal of data lines DL1 to DLn has to be formed on the substrate 1 in order to realize a high resolution. Therefore, intervals between the lines to be formed get narrower and thus, signal interference occurs between the lines, thereby resulting in degradation of image quality.

To solve such problem, a block driving method was employed, which can supply image signals to the entire pixels P1 by limiting the number of data lines DL1 to DLn to be formed on the substrate 1 and repeatedly using the formed data lines DL1 to DLN many times.

The aforementioned block driving method will now be described in detail with reference to the accompanying drawings.

FIG. 2 is an exemplary view showing a block-driven organic electroluminescence display.

Referring to FIG. 2, the organic electroluminescence display includes a plurality of gate lines GL11 and GL12 and data lines DL11 to DL1*n* arranged on a substrate at regular intervals, a plurality of signal lines 140 arranged on the substrate at regular intervals, crossing the gate lines GL11 and GL12, and connected to the data lines DL11 to DL12, a plurality of pixels P11 provided on areas defined by the signal lines 140 and the gate lines GL11 and GL12 crossing each other, and a plurality of switching blocks BL1 to BLk provided on the signal lines 140, respectively, and controlling image signals delivered to the pixels P11 via the data lines DL11 to DL1*n*.

In the block driving method, the display device is driven by dividing the entire screen of the display device and supplying image signals to pixels P11 via each switching block BL1 to BLk. In FIG. 2, a multiplicity of switching blocks BL1 to BLk for dividing the entire screen perpendicularly is shown.

In the drawing, the data lines DL11 to DL1*n* are formed on the substrate in a horizontal direction which is the same as the direction of the gate lines GL11 and GL12. As above, the number of the data lines DL11 to DL1*n* formed on the substrate is consistent with the number of the signal lines 140 connected to each of the switching block BL1 to BLk. That is, only the number of the data lines DL11 to DL1*n* required for simultaneously transmitting an image signal to one switching block BL1 to BLk are formed. The switching blocks BL1 to BLk consist of a plurality of switches 111, and each switch 111 is electrically connected to the data lines DL11 to DL1*n*, respectively, via the signal lines 140.

The signal lines 140 and the gate lines GL11 and GL12 define a plurality of pixels P11 by crossing each other perpendicularly. The pixels P11 are arranged in a matrix on the substrate.

Each of the pixels P11 is provided with a device, such as a thin film transistor. This thin film transistor is electrically connected to the gate lines GL11 and GL12 and the signal lines 140.

One side of the signal lines 140 is electrically connected to one of the plurality of data lines DL11 to DL1*n*, while the other side thereof is electrically connected to one of the plurality of pixels P11. Each of the signal lines is provided with a switch 111 for conducting or blocking signals from the pixels P11 to the data lines DL11 to DL1*n*.

In the thus constructed organic electroluminescence display, when scanning signals are applied to the gate lines GL11 and GL12, the thin film transistors connected to the corresponding gate lines GL11 and GL12 are turned on. An image signal applied to the data lines DL11 to DL1*n* during the turn-on period is applied to the pixels P11 in units of the switching blocks BL1 to BLk via the signal lines 140.

Because the plurality of data lines DL11 to DL1*n* are commonly connected to each switching block BL1, they do not need to be formed so as to correspond to the entire substrate and the number of data lines to be formed can be reduced.

FIG. 3 is an exemplary view showing the timing of signals upon block driving.

Firstly, though a low voltage driving or high voltage driving may be selected according to the type of thin film transistors provided in the pixels, a description thereof will be based on a p-type thin film transistor that is turned on at a low voltage level.

As shown in FIG. 3, a scanning signal GS11 supplied from a gate driving unit (not shown) to gate lines is changed from a high voltage level to a low voltage level, block driving signals BE11 to BE1*k* are sequentially applied to switching blocks in a low voltage level section.

When each block driving signal BE11 to BE1*k* is sequentially applied to each switching block corresponding to the entire panel in a first horizontal period during which the scanning signal GS11 maintains a low potential level, every switching block is conductive once and image signals are supplied to corresponding pixels via the connected switching blocks. In this manner, the pixels connected to the gate lines, to which the scanning signal GS11 is applied in the first horizontal period, are all supplied with the image signals. As shown therein, the first block driving signal BE11 to the K-th block driving signal BE1*k* are applied at a low potential level pulse.

Generally, a resistance component, a capacitor component and a conductance component exist on a line to which an electric signal is delivered. Likewise, a capacitor component exists on the aforementioned signal lines, and thus the problem of signal distortion may occur.

In a case where block driving signals BE11 to BE1*k* are sequentially supplied to the switching blocks during the first horizontal period, the signal lines electrically connected to each switch of the switching blocks switched on are supplied with image signals from the data lines. Consequently, these image signals are supplied to the pixels. Since the scanning signal GS11 sequentially applied to the gate lines is generated at regular intervals so that each signal does not overlap with each other, it is not until a predetermined (dummy) time passes after the scanning signal GS11 becomes a low voltage level that the next scanning signal GS11 is generated.

However, a portion of the electric charge corresponding to the image signals remain on the signal lines even during this dummy time, and may affect the driving of the pixels. Moreover, as shown therein, as each switching block is conductive during the previous horizontal period, the image signals applied to the signal lines cannot be supplied with new image signal until each switching block is conductive in the next horizontal period. For example, the image signals applied in the previous horizontal period still remain on the signal lines during a dummy time A from the falling edge of the scanning signal GS11 to the first block driving signal BE11, a dummy time B from the falling edge of the scanning signal GS11 to the second block driving signal BE12, and a dummy time C from the falling edge of the scanning signal GS11 to the k-the block driving signal BE1*k*. Therefore, the image signals corresponding to the previous horizontal period may be supplied to the organic electroluminescence device of the pixels during the dummy times A, B and C of the next horizontal period. The above organic electroluminescence device may generate undesired light emission by maintaining components of the image signals applied during the short dummy times A, B and C because it has a fast reaction speed. This problem may not be serious in a liquid crystal display using liquid crystal with relatively low reaction speed, but may lead to picture quality degradation in the organic electroluminescence device. Especially, in a case where white images with a high brightness are displayed in the pixels in the previous horizontal period and black images with a low brightness are displayed in the same pixels in the next horizontal period, the light emission of the luminescence device caused by the remaining components of the image signals will degrade the picture quality greatly.

SUMMARY OF THE INVENTION

By way of introduction only, an organic electroluminescence display and method of display are presented which prevent picture quality degradation by suppressing light emission from a light emitting element caused by components of image signals remaining on signal lines by supplying a lowest gray level voltage to each of the signal lines prior to supplying a new image signal.

In one aspect, an organic electroluminescence display comprises: a plurality of data lines and gate lines arranged on a substrate in a first direction; a plurality of signal lines arranged on the substrate in a second direction and electrically connected to the data lines, respectively; a plurality of pixel regions defined by the gate lines and the signal lines crossing each other; switching elements provided in the pixel regions, respectively, and electrically connected to the signal lines and the gate lines; a plurality of switching blocks that open and close an electrical connection between the signal lines and the pixels; a second driving unit that makes conductive the switching elements connected to the corresponding gate lines and the signal lines by outputting scanning signals to the gate lines; a first driving unit that outputs a first control signal for each horizontal period before the second driving unit outputs scanning signals, sequentially making conductive the switching blocks by a second control signal, and outputting image signals to the data lines; and a pre-charging unit connected between the signal lines and the first driving unit, the pre-charging unit being made conductive according to the first control signal of the first driving unit for setting the signal lines at a set voltage supplied from the first driving unit.

In another aspect, a method of driving an organic electroluminescence display is presented. The organic electroluminescence display comprises a plurality of data lines and gate lines arranged on a substrate in a first direction, a plurality of signal lines electrically connected to the data lines, respectively, a plurality of pixels electrically connected to the gate lines and the signal lines, and a plurality of switching blocks for conducting or blocking image signals supplied to the pixels via the signal lines. The method comprises providing a pre-charging unit electrically connected to the signal lines; applying a set voltage to the signal lines through the pre-charging unit; maintaining the set voltage on the signal lines; applying scanning signals to the pixels via the gate lines; making the switching blocks conductive one by one; supplying image signals to the pixels via the signal lines by applying the image signals to the signal lines through the conductive switching blocks; and displaying images according to the image signals by the pixels.

In another aspect, an organic electroluminescence display comprises: a plurality of data lines and gate lines arranged on a substrate in a first direction; a plurality of signal lines arranged on the substrate in a second direction and electrically connected to the data lines, respectively; a plurality of pixel regions defined by the gate lines and the signal lines crossing each other; a plurality of switching blocks for opening and closing an electrical connection between the signal lines and the pixels; a first driving unit for outputting a first image signal and a second image signal to the data lines, setting the signal lines to a voltage level of the first image signal by making the switching blocks conductive by a first control signal and a second control signal and supplying the second image signal to the pixel regions via the signal lines; and a second driving unit for outputting scanning signals to the gate lines after the first driving unit outputs the first control signal.

In another aspect, a method of driving an organic electroluminescence display is presented. The organic electroluminescence display comprises a plurality of data lines and gate lines arranged on a substrate in a first direction, a plurality of signal lines electrically connected to the data lines, respectively, a plurality of pixels electrically connected to the gate lines and the signal lines, and a plurality of switching blocks for conducting or blocking image signals supplied to the pixels via the signal lines. The method comprises applying a first control signal to every switching block to make every switching block conductive; applying a first image signal of a set voltage level to the signal lines through the conductive switching blocks; terminating the first control signal; applying scanning signals to the pixels via the gate lines; sequentially applying a second control signal to the switching blocks to make the switching blocks sequentially conductive; supplying a second image signal to the pixels via the signal lines by applying the second image signal to the signal lines through the conductive switching blocks; and displaying images according to the second image signal at the pixels.

In another aspect, a method of driving an organic electroluminescence display is presented. The organic electroluminescence display comprises a plurality of data lines and gate lines arranged on a substrate in a first direction, a plurality of signal lines electrically connected to the data lines, respectively, a plurality of pixels electrically connected to the gate lines and the signal lines, and a plurality of switching blocks that supply signals to the pixels via the signal lines when the switching blocks are conductive. In each display cycle the method comprises: supplying a set voltage level to all of the signal lines prior to applying scanning signals to the pixels via the gate lines; applying scanning signals to the pixels via the gate lines; sequentially applying a control signal to first switching blocks of the plurality of switching blocks to make the first switching blocks sequentially conductive; supplying image signals to the signal lines through the conductive first switching blocks; and terminating supply of the image and scanning signals to the pixels after all pixels have been supplied with the image signal.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
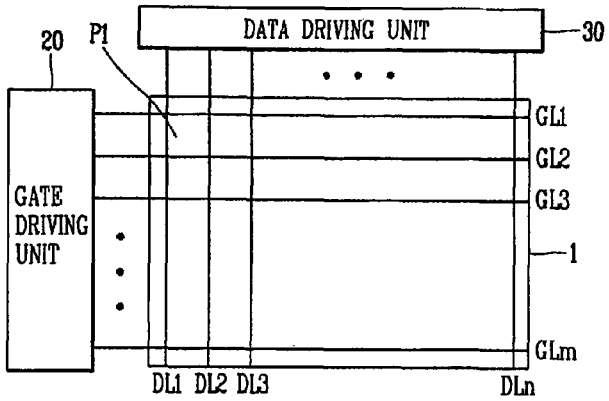
FIG. 1 RELATED ART
FIG. 1 is an exemplary view showing a general active matrix organic electroluminescence display.
Figure 2:
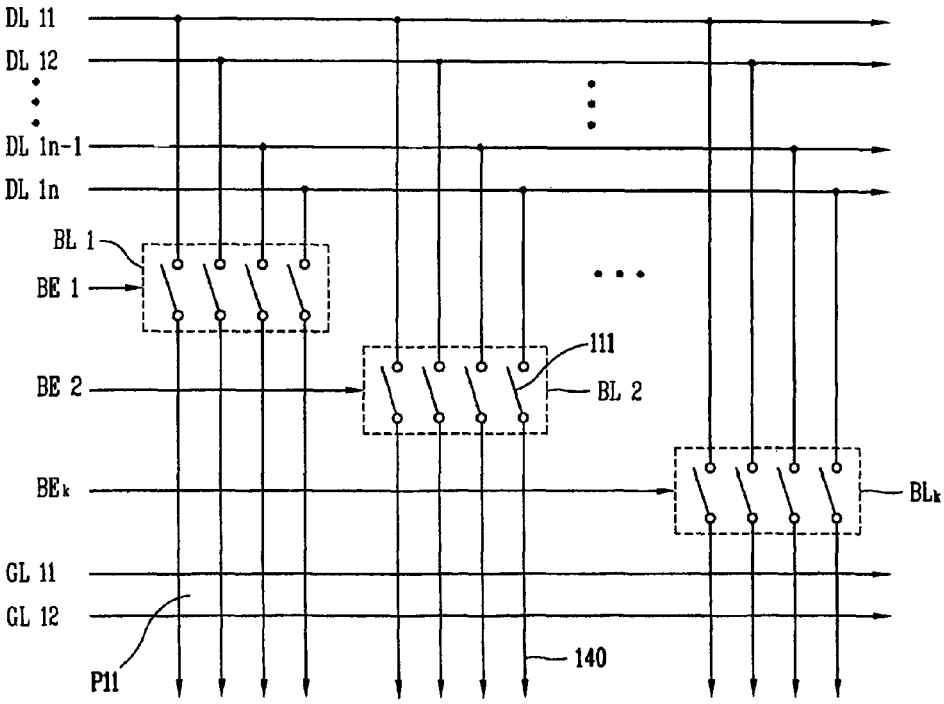
FIG. 2 RELATED ART
FIG. 2 is an exemplary view showing a block-driven organic electroluminescence display.
Figure 3:
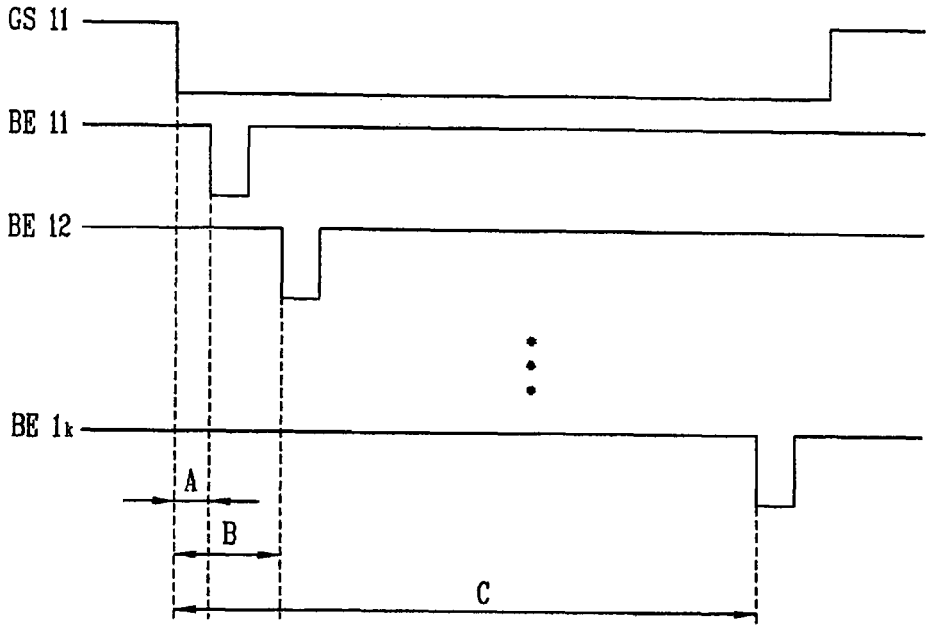
FIG. 3 RELATED ART
FIG. 3 is an exemplary view showing the timing of signals upon block driving.
Figure 4:
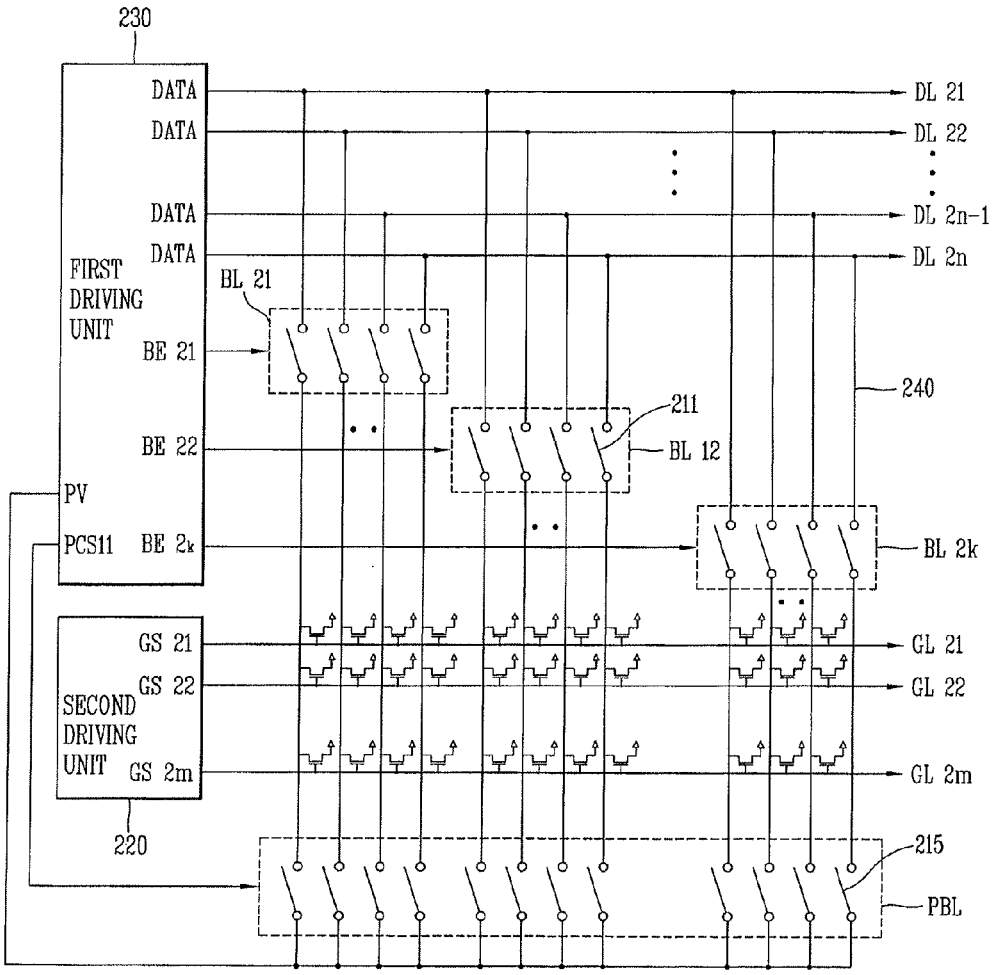
FIG. 4 is a view showing an organic electroluminescence display according to a first embodiment of the present invention.

FIG. 4 is a view showing an organic electroluminescence display according to a first embodiment of the present invention.

Referring to FIG. 4, the organic electroluminescence display includes; a plurality of data lines DL21 to DL2*n* arranged at regular intervals on a substrate in a transverse direction; a plurality of gate lines GL21 to GL2*n* arranged on the substrate in the same direction as the data lines DL21 to DL2*n*; a plurality of signal lines 240 electrically connected to the data lines DL21 to DL2*n* and the gate lines GL21 to GL2*m*; a plurality of pixels P21 provided on areas defined by the gate lines GL21 to GL2*m* and the data lines DL21 to DL2*n* crossing each other; a plurality of switching blocks BL21 to BL2*k* provided on the signal lines 240, respectively, and conductive or blocked by block driving signals BE21 to BE2*k* for applying image signals D1 to Dn applied from the data lines DL21 to DL2*n* to the pixels P21; a first driving unit 230 for supplying an image signal DATA to the signal lines 240 via the data lines DL21 to DL2*n*; a second driving unit 220 for supplying scanning signals GS21 to GS2*m* to the gate lines GL21 to GL2*m*; and a pre-charging block PBL connected to the ends of the signal lines 240, respectively, and made conductive by a pre-charge signal PCS11 of the first driving unit 230 for applying a setting voltage PV to the signal lines 240.

The data lines DL21 to DL2*n* are electrically connected to the pixels P21 via the signal lines 240. The signal lines 240 are formed at regular intervals on the substrate in a perpendicular direction, thus they cross the data lines DL21 to DL2*n* and the gate lines GL21 to GL2*m*. The pixels P21 are provided on areas defined by the gate lines GL21 to GL2*m* and the data lines DL21 to DL2*n* crossing each other.

The pixels P21 are arranged in a matrix on the substrate, and are provided with thin film transistors (not shown), respectively. The thin film transistors are electrically connected to the data lines DL21 to DL2*n* and the gate lines GL21 to GL2*m*, so they are driven by signal delivered via the data lines DL21 to DL2*n* and the gate lines GL21 to GL2*m*.

A plurality of signal lines 240 are electrically connected to each of the plurality of switching blocks BL21 to BL2*k* formed on the substrate, and the switching blocks BL21 to BL2*k* are commonly connected to the data lines DL21 to DL2*n* via the signal lines 240. Thus, the same image signals can be supplied to any switching blocks BL21 to BL2*k* via the signal lines 240 by only a small number of data lines DL21 to DL2*n*. The switching blocks BL21 to BL2*k* consist of a plurality of switches 211. The switches 211 are devices that are turned on or turned off by block driving signals BE21 to BE2*k*. The switches 211 correspond to the signal lines 240, respectively, and the switches 211 provided on the same switching blocks BL21 to bL2*k* are simultaneously turned on or turned off by the block driving signals BE21 to BE2*k*. That is, because the switches 211 perform the same operation even if the switching blocks BL21 to BL2*k* are provided with the plurality of switches 211, the switching blocks BL21 to BL2*k* perform one of integrated operations including conducting and blocking.

One side of each switch 211 provided on the switching blocks BL21 to BL2*k* is connected to the data lines DL21 to DL2*n* via the signal lines 240, while the other side of each switch 211 is connected to the pre-charging block PBL via the signal lines 240.

The first driving unit 230 supplies image signals D1 to DN to the data lines DL21 to DL2*n*, and sequentially applies block driving signals BE21 to BE2*k* to the switching blocks BL21 to BL2*k*. Since every switching block BL21 to BL2*k* is commonly connected to the data lines DL21 to DL2*n*, only one of the switching blocks BL21 to BL2*k* is made conductive by the block driving signals BE21 to BE2*k*. The block driving signals BE21 to BE2*k* are supplied once to every switching block BL221 to BL2*k* within the first horizontal period.

The first driving unit 230 applies a pre-charge signal PCS11 to the pre-charging block PBL. A plurality of switches 215 of the pre-charging block PBL are simultaneously turned on by this pre-charge signal PCS11. A thin film transistor may be applicable to the switches 215. As above, in a case where the pre-charging block PBL is made conductive by the pre-charge signal PCS11, the first driving unit 230 applies an initialization voltage PV to the pre-charging block PBL via the line commonly connected to the switches 215 of the pre-charging block PBL. The initialization voltage PV is applied to the signal lines 240 through the pre-charging block PBL.

Meanwhile, the second driving unit 220 sequentially applies scanning signals GS21 to GS2*m* to the gate lines GL21 to GL2*m* in each frame. While the scanning signals GS21 to GS2*m* are applied to the gate lines GL21 to GL2*m*, a plurality of thin film transistors electrically connected to the corresponding gate lines GL21 to GL2*m* enter a turned-on state. The first driving unit 230 supplies image signals D1 to DM to the data lines DL21 to DL2*m*, and sequentially applies block driving signals BE21 to BE2*k* to the switching blocks BL21 to BL2*k*. Therefore, only one of the switching blocks BL21 to BL2*k* is made conductive, to thus deliver the image signals D1 to Dn of the data lines DL21 to DL2*n* to the pixels P21. Though not shown in the drawings, a light emitting element (not shown) provided in the pixels P21 emits light according to the input image signals D1 to DN. The aforesaid driving of the first driving unit 230 and second driving unit 220 is all performed during the first horizontal period, and is repeated in each horizontal period.

The first driving unit 230 and the second driving unit 220 may be constructed as separate circuits, but also may be constructed as an integrated circuit.

The pixels P21 are supplied with image signals D1 to Dn in units of switching blocks BL21 to BL2*k*. Because the switching blocks BL21 to BL2*k* are conductive only once in the first horizontal period, the image signals D1 to Dn are applied to the signal lines 240 through the conducted switching blocks BL21 to BL2*k*. If every switch 211 of the switching blocks BL21 to BL2*k* is blocked after a predetermined time, the signal lines 240 enter a floating state, and thus a portion of the remaining charge of the image signals D1 to DN are left on the signal lines 240. That is, the signal lines 240 have a constant voltage level, and this voltage level is introduced into the pixels P21 until the corresponding switching blocks BL21 to BL2*k* are made conductive to apply new image signals D1 to DN to the signal lines 240 even if the next horizontal period has arrived.

To prevent degradation of picture quality caused by remaining components of the image signals D1 to Dn left on the signal lines 240, the pre-charging block PBL is provided. A detailed description of the driving of the organic electroluminescence display of FIG. 4 will be presented, including FIG. 5 in which a driving waveform is shown.

Figure 5:
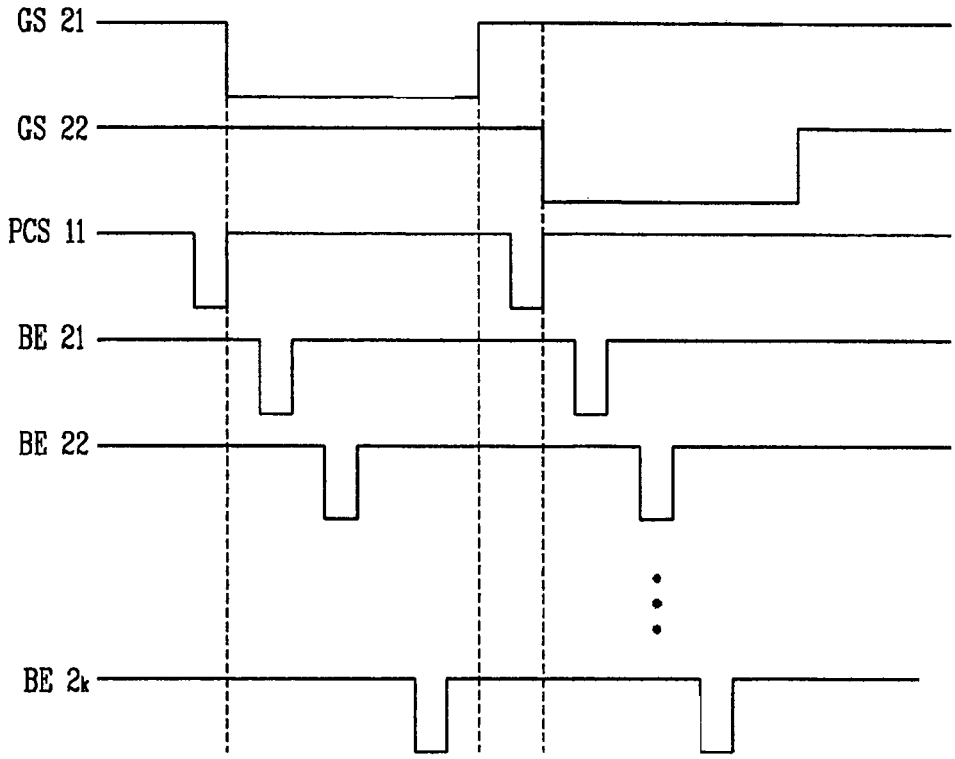
FIG. 5 is a timing diagram showing the driving waveform of a signal of FIG. 4.

FIG. 5 is a timing diagram showing the driving waveform of a signal of FIG. 4.

The driving waveform of FIG. 5 is shown under the assumption that a p-type transistor, which is turned on at a low voltage level, is applied to both switches 211 of the switching blocks BL21 to BL2*k* of FIG. 4 and the switches 215 of the pre-charging block PBL. Hence, in a case where the p-type transistor of the switches 211 and 215 is replaced by an n-type, the potential of the driving waveform of FIG. 5 has to be replaced by an opposite potential.

The organic electroluminescence display displays images at a plurality of gray levels like a liquid crystal display does. The gray levels mean brightness levels of an image. The organic electroluminescence device has a different light emission brightness according to the size of a supplied current or voltage. Thus, remaining components of image signals D1 to Dn are left on the signal lines 240, the gray level of an image can be varied by changing the intensity of light emitting from the organic electroluminescence device. Hence, in order to prevent an image of an undesired gray level from being displayed, a voltage corresponding to the lowest gray level is applied to the signal lines 240 before the organic electroluminescence device emits light by new image signals D1 to Dn, thereby driving the corresponding pixels P21 to display black.

When a first scanning signal GS21 of low voltage level is applied to gate lines GL21 to GL2*m*, the thin film transistors of the pixels P21 connected to the corresponding gate lines GL21 to GL2*m* are all turned on and thus are supplied with image signals D1 to Dn through switching blocks BL21 to BL2*k* sequentially made conductive by block driving signals BE21 to BE2*k*. However, since the block driving signals BE21 to BE2*k* are generated after a predetermined time from the point of time of the falling edge of the first scanning signal GS21 as shown in the drawings, and each block driving signal BE21 to BE2*k* is periodically generated at regular time intervals, a predetermined dummy time exists until each block driving signal BE21 to BE2*k* is generated. The remaining components of the image signals D1 to Dn remaining on the signal lines 240 are removed during this dummy time, so that the remaining components may not be introduced into the pixels P21 through the thin film transistors turned on by the first scanning signal GS21.

As above, in order to remove the image signal D1 to Dn components left on the signal lines 240, the first driving unit 230 outputs a pre-charge signal PCS11 and applies it to the pre-charging block PBL before applying the first scanning signal GS21. The pre-charging block PBL is made conductive to thus apply an initialization voltage PV of the first driving unit 230 to the signal lines 240. The initialization voltage PV is a voltage corresponding to the lowest gray level of an image. If the initialization voltage PV is applied to the organic electroluminescence device of the pixels P21 through the thin film transistors, the organic electroluminescence emits light at the minimum level, and thus the pixels display black. As the initialization voltage PV, a ground voltage can be set. That is, at this time, as the pre-charging block PBL, is conducted, the signal lines 240 are grounded.

After the block driving signals BE21 to BE2*k* are sequentially output from the first driving unit 230 during the low voltage level section of the first scanning signal GS21, the first scanning signal GS21 is changed to a high voltage level. After the passage of a predetermined time, a second scanning signal GS22 of low voltage level is applied to the gate lines GL21 to GL2*m*. After the application of the first scanning signal GS21 is finished, a pre-charge signal PCS11 of low voltage level is re-generated before the second scanning signal GS22 is generated. The first driving unit 230 outputs the pre-charge signal PCS11 and applies it to the pre-charging block PBL before the second driving unit 220 outputs the second scanning signal G32. The pre-charge signal PCS11 is generated in the same cycle as the scanning signals GS21 to GS2*m* of the second driving unit 220, but at a different period within the cycle.

In this way, the first driving unit 230 can remove image signals D1 to Dn components that have been previously left on the signal lines 240 by presetting the signal lines 240 to a certain voltage level through the pre-charging block PBL before the second driving unit 220 outputs scanning signals GS21 to GS2*m*.

In the aforementioned first embodiment of the present invention, a pre-charging block PBL consisting of switches 215 each connected to one side of the signal lines 240 is provided. Additionally, to control the pre-charging block PBL, a circuit for outputting the pre-charge signal PCS21 and the initialization voltage PV is added to the first driving unit 230. Consequently, additional manufacturing costs may be incurred, and the construction may be more complicated than a conventional organic electroluminescence display.

Figure 6:
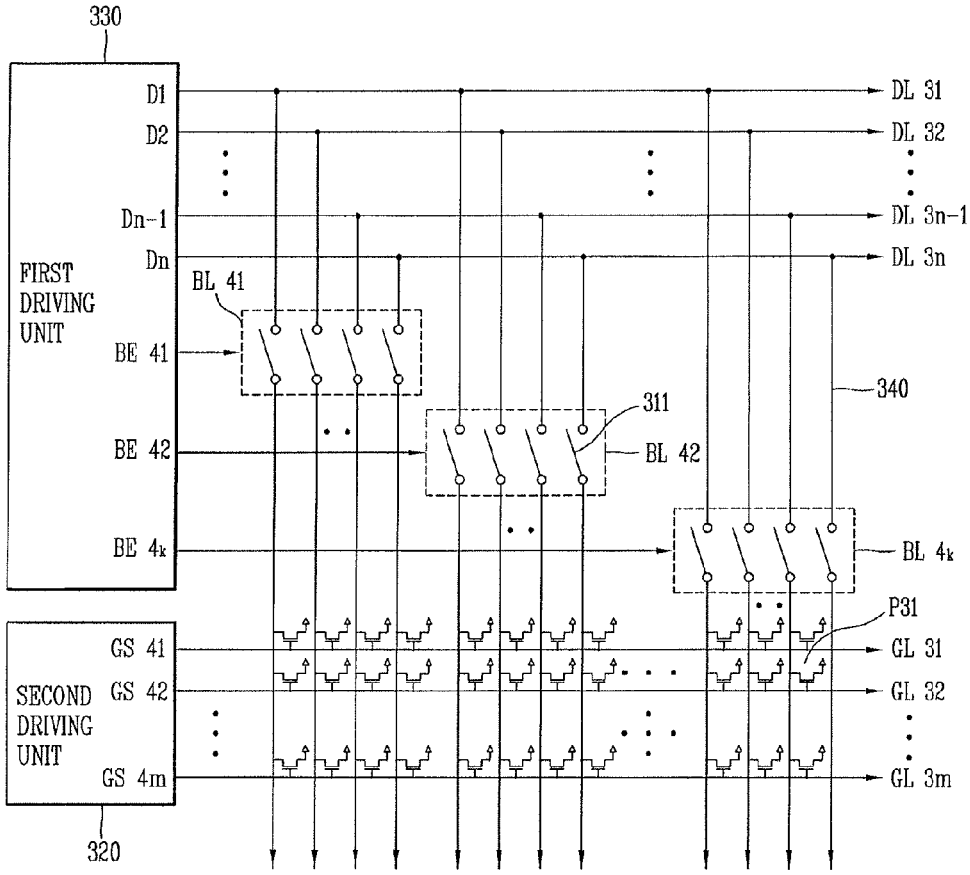
FIG. 6 is a view showing an organic electroluminescence display according to a second embodiment of the present invention.
Figure 7:
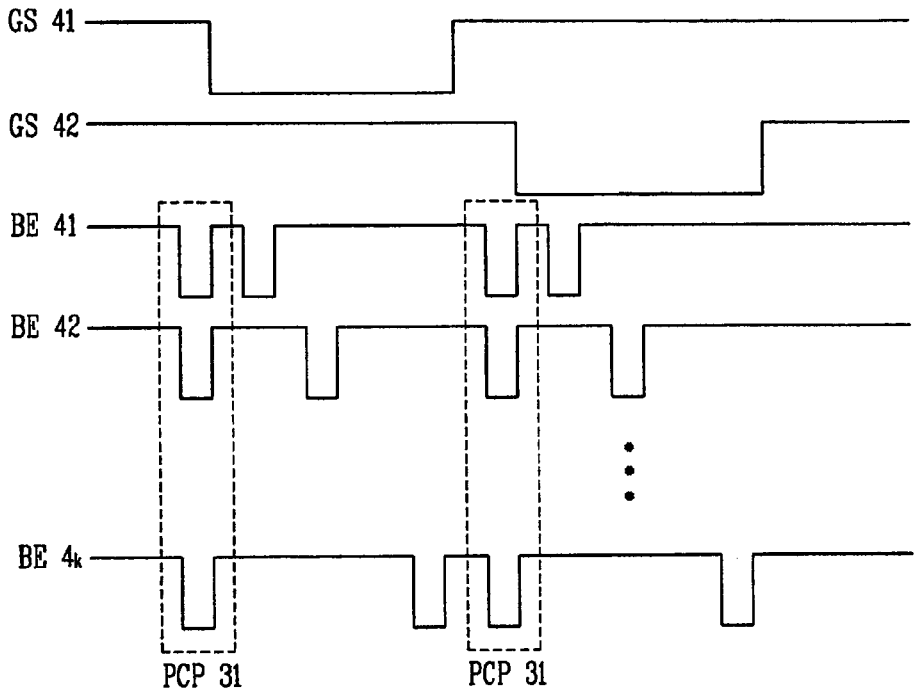
FIG. 7 is a timing diagram showing the driving waveform of a signal of FIG. 6.

Accordingly, FIG. 6 is a view showing an organic electroluminescence display according to a second embodiment of the present invention. FIG. 7 is a timing diagram showing the driving waveform of a signal of FIG. 6.

In the organic electroluminescence display according to the second embodiment, the pre-charge signal of the pre-charging block and the initialization voltage outputting circuit of the first driving unit in the first embodiment can be eliminated. Similar portions of the first and second embodiments will be briefly described.

A plurality of signal lines 340 arranged on a substrate in a longitudinal direction and a plurality of gate lines GL31 to GL3*m* arranged in a transverse direction are crossed perpendicularly to define a plurality of pixels P31. The pixels P31 are arranged in plural number on the substrate along the gate lines GL31 to GL3*m*. Each pixel P31 is provided with a thin film transistor (not shown) electrically connected to the gate lines GL31 to GL3*m* and the signal lines 340.

When a second driving unit 320 sequentially outputs scanning signals GS41 to GS4*m* to the gate lines GL31 to GL3*m*, the thin film transistors of the pixels P31 connected to the corresponding gate lines GL31 to GL3*m* to which the scanning signals GS41 to GS4*m* are applied are all turned on.

The first driving unit 330 applies image signals D11 to D1*n* to the gate lines DL31 to DL3*n*, and the image signals D11 to D1*n* are applied to the pixels P31 conducted by the scanning signals GS41 to GS4*m* of the second driving unit 320 via the signal lines 340 connected to the data lines DL31 to DL3*n*. That is, the driving timing of the first driving unit 330 is synchronized with the driving timing of the second driving unit 320.

In order for the image signals D11 to D1*n* output from the first driving unit 330 to be delivered to the pixels P31, the switching blocks BL41 to BL4*k* are sequentially made conductive. The first driving unit 330 sequentially applies block driving signals BE41 to BE4*k* to the switching blocks BL41 to BL4*k*.

However, while in the first embodiment, the signal lines are first set at a certain voltage by the first driving unit 230 outputting a pre-charge signal to make a pre-charging block conductive before the second driving unit 220 outputs scanning signals GS21 to GS2*m* in every horizontal period, in the second embodiment, the same driving as in the first embodiment is performed using block driving signals supplied to the switching blocks BL41 to BL4*k* without a pre-charging block.

As shown therein, the first driving unit 330 increases the number of times of outputting block driving signals BE41 to BE4*k* for every horizontal period. That is, for every horizontal period, the first driving unit 330 simultaneously outputs every block driving signal BE41 to BE4*k* before the second driving unit 320 outputs scanning signals GS41 to GS4*m*. Therefore, every switching block BL41 to BL4*k* formed on the substrate is simultaneously made conductive to thus conduct the signal lines 340 and data lines DL31 to DL3*n* at the pixels P31 side through the switching blocks BL41 to BL4*k*. The block driving signals BE41 to BE4*k* simultaneously generated from the first driving unit 330 are referred to as a pre-charge pulse PCP31 for the convenience of explanation. The pre-charge pulse PCP31 is output during a dummy section in which the previous scanning signals GS41 to GS4*m* are changed to a high voltage level and the next scanning signals GS41 to GS4*m* are not output yet.

As above, in order to increase the number of times of outputting block driving signals BE41 to BE4*k*, the output timing of the first driving unit 330 may be controlled. The first driving unit 330 and the second driving unit 320 are integrated, thus signals may be output by internal synchronization of the output timing of every signal.

With every switching block BL41 to BL4*k* made conductive by the pre-charge pulse PCP31 simultaneously output from the first driving unit 330, all of the signal lines 340 are set to a predetermined voltage level. However, since no pre-charge block is provided in the second embodiment, the signal lines 340 can all be set to a certain voltage level by adjusting the voltage level of the image signals D1 to D1*n* delivered to the signal lines 340 via the data lines DL31 to DL3*n*. That is, like the first embodiment, the voltage level of the image signals D1 to D1*n* are set to the lowest gray level voltage before the second driving unit 320 outputs scanning signals GS41 to GS4*k* so that the signal lines 340 may be set to the lowest gray level voltage. Alternatively, the signal lines 340 may be set to a ground voltage by applying a ground voltage to the data lines DL31 to DL3*n*.

As described above, it is possible to prevent the picture quality of the organic electroluminescence display from being degraded, due to the light emitting element of the pixels emitting light by a voltage left on the signal lines before new images are displayed from the pixels, by presetting the signal lines electrically connected to the pixels to a certain voltage before scanning signals are output to conduct the pixels according to the first embodiment and second embodiment.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic electroluminescence display, comprising:

a plurality of a first to a $n^{th}$ data lines (DL1~DLn) and a first to a $m^{th}$ gate lines (GL1~GLm) arranged on a substrate;

a plurality of signal lines arranged on the substrate;

a plurality of pixel regions defined by the gate lines and the signal lines;

switching elements provided in the pixel regions, respectively, and electrically connected to the signal lines and the gate lines;

a plurality of switching blocks disposed in the signal lines to open and close an electrical connection between the signal lines and the pixels, each switching block including a plurality of first switches;

a second driving unit for causing the switching elements connected to the corresponding gate lines conductive by outputting scanning signals to the gate lines;

a first driving unit which outputs a first control signal to a pre-charging unit for each horizontal period before the second driving unit outputs the scanning signals, and outputs a second control signal to cause the switching blocks conductive sequentially to output image signals to the data lines; and wherein the pre-charging unit is directly connected to the signal lines and the first driving unit, and the first driving unit supplies a set voltage to the signal lines according to the first control signal of the first driving unit, wherein the set voltage is applied to the signal lines before a scanning signal is applied to the gate lines, wherein the plurality of switching blocks are connected to the pre-charging unit and to all of the data lines such that the plurality of first switches are connected to the data lines;

wherein the data lines and the gate lines are parallel each other, the signal lines being perpendicular to the gate lines, the number of the signal lines connected to each of switching blocks being same as the number of the data lines, each switching block including the plurality of first switches, each switching block being respectively connected to all of the data lines (DL1~DLn) respectively, and the pre-charging unit includes a plurality of second switches connected respectively to the plurality of signal lines, wherein the first switches of one switching block are simultaneously turned on and the plurality of switching blocks are successively operated, wherein the first switches of one switching block are disposed between the pre-charging unit and the signal lines, a total number of the first switches are equal to a total number of the second switches, wherein the first driving unit is connected to the first to the $n^{th}$ data lines (DL1~DLn) and supplies the second control signal to the plurality of switching blocks.

2. The organic electroluminescence display of claim 1, wherein the set voltage is a lowest gray level voltage.

3. The organic electroluminescence display of claim 1, wherein the set voltage is a ground voltage.

4. The organic electroluminescence display of claim 1, wherein the second control signal and the scanning signals are generated in the same cycle.

5. The organic electroluminescence display of claim 1, wherein the switching elements are thin film transistors.

6. The organic electroluminescence display of claim 1, wherein the pre-charging unit comprises a plurality of elements, one side of which are connected to the signal lines, respectively, and another side of which are connected to the switching elements of the pixels, respectively.

7. The organic electroluminescence display of claim 6, wherein the elements are thin film transistors.

8. The organic electroluminescence display of claim 1, wherein the first driving unit and the second driving unit are integral with each other.

9. A method of driving an organic electroluminescence display, comprising:

providing the organic electroluminescence display, wherein the organic electroluminescence display includes:

a plurality of a first to a $n^{th}$ data lines (DL1~DLn) and a first to a $m^{th}$ gate lines (GL1~GLm) arranged on a substrate, data lines and the gate lines being parallel each other;

a plurality of signal lines arranged on the substrate, the signal lines being perpendicular to the gate lines, the number of the signal lines connected to each of k switching blocks being same as the number of the data lines;

a plurality of switching elements provided in the pixel regions, respectively, and electrically connected to the signal lines and the gate lines;

a plurality of switching blocks that open and close an electrical connection between the signal lines and the pixels, each of the plurality of switching blocks including a plurality of first switches, and each of the plurality of switching blocks being connected to all of the data lines such that each of the plurality of first switches being connected to one respective data line, the one respectively data line being connected to one respective first switch through the corresponding signal line; and a pre-charging unit including a plurality of second switches being directly connected to the signal lines and a first driving unit, wherein the first driving unit supplies a set voltage to the signal lines according to a first control signal, wherein the set voltage is applied to the signal lines before a scanning signal is applied to the gate lines;

applying by a second driving unit, the scanning signal to the pixels connected to the $(m-1)^{th}$ gate line;

causing the plurality of switching blocks conductive one by one sequentially according to a second control signal sent from the first driving unit;

supplying image signals to the pixels connected to the $(m-1)^{th}$ gate line via the signal lines, by applying the image signals to the signal lines through the plurality of conductive switching blocks; and displaying images at the pixels connected to the $(m-1)^{th}$ gate line (GLm−1) according to the image signals, applying by the first driving unit, the set voltage to the pixels electrically connected to the $(m-1)^{th}$ gate line (GLm−1) by turning on the pre-charging unit according to the first control signal from the first driving unit, after blocking the scanning signal applied to the $(m-1)^{th}$ gate line (GLm−1) from the second driving unit;

maintaining the pixels connected to the $(m-1)^{th}$ gate line as a black state;

applying the scanning signal to the pixels connected to the $m^{th}$ gate line (GLm) from the second driving unit, after blocking the first control signal;

causing the plurality of switching blocks conductive one by one sequentially according to the second control signal sent from the first driving unit for driving the plurality of switching blocks;

supplying the image signals to the pixels connected to the $m^{th}$ gate line (GLm) via the signal lines by applying the image signals to the signal lines through the plurality of conductive switching blocks; and displaying the images at the pixels connected to the $m^{th}$ gate line (GLm) according to the image signals, wherein the plurality of first switches in a first of the plurality of switching blocks are simultaneously turned on, wherein a remaining of the plurality of switching blocks are successively operated, wherein the plurality of switching blocks are disposed between the pre-charging unit and the data lines, wherein a total number of the plurality of first switches in the plurality of switching blocks are equal to a total number of the plurality of second switches in the pre-charging unit, wherein the first driving unit is directly connected to the first to the $n^{th}$ data lines (DL1~DLn), and supplies the second control signal to cause the plurality of switching blocks conductive sequentially to output the image signals to the data lines.

10. The method of claim 9, wherein the set voltage is a lowest gray level voltage.

11. The method of claim 9, wherein the set voltage is a ground voltage.

12. The method of claim 9, wherein the set voltage is applied to the signal lines before the scanning signals are applied to the gate lines.

13. The method of claim 9, wherein the set voltage is applied to the signal lines before the plurality of switching blocks are made conductive.

14. The method of claim 9, wherein the plurality of switching blocks are made conductive while scanning signals are being applied to the gate lines.

15. An organic electroluminescence display, comprising:

a plurality of a first to a $n^{th}$ data lines (DL1~DLn) and a plurality of a first to a $m^{th}$ gate lines (GL1~GLm) arranged on a substrate;

a plurality of signal lines arranged on the substrate;

a plurality of pixel regions defined by the plurality of gate lines and the plurality of signal lines;

a plurality of switching blocks disposed in the plurality of signal lines to open and close an electrical connection between the plurality of signal lines and the plurality of pixels, each of the plurality of switching blocks includes at least n first switches, each of the switching blocks being connected to all of the plurality of data lines such that each of the at least n first switches being connected to a respective data line;

a first driving unit outputs a pre-charging signal to a pre-charging unit for each horizontal period before a second driving unit outputting scanning signals, which wherein the first driving unit outputs image signals to the plurality of data lines and outputs a block driving signal which causes the plurality of switching blocks conductive one by one sequentially to output the image signals to the plurality of data lines; and wherein the pre-charging unit is directly connected to the plurality of signal lines and the first driving unit, and wherein the first driving unit supplies a set voltage to the plurality of signal lines according to the pre-charging signal before the scanning signals are applied to the plurality of gate lines, and the plurality of switching blocks are connected to the pre-charging unit and to all of the plurality of data lines;

wherein the set voltage supplied to the plurality of signal lines causes all the at least first n switches in the plurality of switching blocks conductive at a same time according to the block driving signal, wherein the block driving signal to the plurality of switching blocks are synchronized with a time between a turned-off one gate line and a turned-on next gate line in order to maintain the pixels connected to the one gate line in a black state;

the second driving unit for outputting scanning signal to the $m^{th}$ gate line (GLm) after the first driving unit outputs the pre-charge signals, wherein the plurality of data lines and the plurality of gate lines are parallel to each other, the plurality of signal lines are perpendicular to the plurality of gate lines, the number of the plurality of signal lines connected to each of k switching blocks being same as the number of the plurality of data lines, such that the (k×n) signal lines disposed on the substrate and (k×n×m) pixel regions are defined by the plurality of signal lines and the plurality of gate lines, and each of the plurality of switching block including the at least n first switches connected to the first to the $n^{th}$ data lines (DL1~DLn) respectively, wherein one data line being connected to a respective first switch of one switching block through the corresponding signal line, wherein the at least first n switches in a first of the plurality of switching blocks are simultaneously turned on, wherein a remaining of the plurality of switching blocks are successively operated, wherein the plurality of switching blocks are disposed outside of the first driving unit such that the image signal is applied to the at least first n switches, wherein the first driving unit is directly connected to the first to the $n^{th}$ data lines (DL1~DLn) and supplies the block driving signal to the plurality of switching blocks.

16. The organic electroluminescence display of claim 15, wherein the first driving unit applies the first image signal to the plurality of signal lines through the plurality of switching blocks before the second driving unit outputs the scanning signals.

17. The organic electroluminescence display of claim 15, wherein the set voltage is a lowest gray level voltage.

18. The organic electroluminescence display of claim 15, wherein the set voltage is a ground voltage.

19. The organic electroluminescence display of claim 15, wherein the block driving signals and the pre-charging signals are pulses having different output timings generated from the same signal.

20. The organic electroluminescence display of claim 15, wherein the first driving unit simultaneously applies the block driving signals to every switching block.

21. The organic electroluminescence display of claim 15, wherein the pre-charging signals are sequentially applied to the plurality of switching blocks.

22. The organic electroluminescence display of claim 15, wherein the first driving unit outputs the block driving signals in every horizontal period before outputting the pre-charging signals.

23. The organic electroluminescence display of claim 15, wherein the first driving unit outputs the block driving signals at a certain point excepting a section where the second driving unit outputs scanning signals.

24. The organic electroluminescence display of claim 15, wherein the first driving unit and the second driving unit are integral with each other.

25. A method of driving an organic electroluminescence display, comprising:

providing the organic electroluminescence display, wherein the organic electroluminescence display includes:

a plurality of a first to a $n^{th}$ data lines (DL1~DLn) and a first to a $m^{th}$ gate lines (GL1~GLm) arranged on a substrate, data lines and the gate lines being parallel each other;

a plurality of signal lines arranged on the substrate, the signal lines being perpendicular to the gate lines, the number of the signal lines connected to each of k switching block being same as the number of the data lines;

a plurality of pixel regions defined by the gate lines and the signal lines;

switching elements provided in the pixel regions, respectively, and electrically connected to the signal lines and the gate lines; and a plurality of switching blocks that open and close an electrical connection between the signal lines and the pixels, each of the plurality of switching blocks including at least n first switches, and each of the plurality of switching blocks being connected to all of the data lines such that each of the at least n first switches being connected to one respective data line, the one respectively data line being connected to one respective first n switches through the corresponding signal line;

a pre-charging unit including a plurality of second switches being directly connected to the signal lines and a first driving unit, wherein the first driving unit supplies a set voltage to the signal lines according to a first control signal, wherein the set voltage is applied to the signal lines before a scanning signal is applied to the gate lines;

applying by a second driving unit, the scanning signal to the pixels which are electrically connected to a $(m-1)^{th}$ gate line;

causing the plurality of switching blocks conductive sequentially according to a second control signal sent by the first driving unit for driving the plurality of switching blocks;

supplying image signals to the pixels connected to the $(m-1)^{th}$ gate line via the signal lines, by applying the image signals to the signal lines through the conductive plurality of switching blocks; and displaying images at the pixels connected to the $(m-1)^{th}$ gate line (GLm−1) according to the image signals;

applying by the first driving unit, the set voltage to the pixels electrically connected to the $(m-1)^{th}$ gate line (GLm−1) by turning on the pre-charging unit according to the first control signal from the first driving unit, which in turn turning on the plurality of switching blocks at one time, after blocking the scanning signal applied to the $(m-1)^{th}$ gate line (GLm−1) from the second driving unit;

maintaining the pixels connected to the $(m-1)^{th}$ gate line as a black state;

applying the scanning signal to the pixels connected to the $m^{th}$ gate line (GLm) from the second driving unit, after blocking the first control signal;

causing the plurality of switching blocks conductive one by one sequentially according to the second control signal sent from the first driving unit for driving the plurality of switching blocks;

supplying the image signals to the pixels connected to the $m^{th}$ gate line (GLm) via the signal lines by applying the image signals to the signal lines through the plurality of conductive switching blocks; and displaying the images at the pixels connected to the $m^{th}$ gate line (GLm) according to the image signals, wherein each data line is connected to a plurality of signal lines, wherein the plurality of first switches in a first of the plurality of switching blocks are simultaneously turned on, wherein a remaining of the plurality of switching blocks are successively operated, wherein the plurality of switching blocks are disposed at the outside of the first driving unit such that the image signal is applied to the first n switches, wherein the first driving unit is directly connected to the first to the $n^{th}$ data lines (DL1~DLn), and supplies the second control signal to cause the plurality of switching blocks conductive sequentially to output the image signals to the data lines.

26. The method of claim 25, wherein the first control signal is output in each cycle before the second control signal is output.

27. The method of claim 25, wherein the first control signal is output at a time other than when scanning signals are output to the gate lines.

28. The method of claim 25, wherein the second control signal is sequentially output when the scanning signals are output to the gate lines.

29. The method of claim 25, wherein the first image signal is a lowest gray level voltage.

30. The method of claim 25, wherein the first image signal is a ground voltage.

* * * * *